US006523686B1

(12) United States Patent
Bae

(10) Patent No.: US 6,523,686 B1
(45) Date of Patent: Feb. 25, 2003

(54) CASE FOR GOLF BALL

(76) Inventor: Sung-woo Bae, 134-68 Anam-dong 5-Ga, Seongbuk-gu, Seoul (KR)

( * ) Notice: Subject to any disclaimer, the term of this patent is extended or adjusted under 35 U.S.C. 154(b) by 0 days.

(21) Appl. No.: 09/688,638

(22) Filed: Oct. 16, 2000

(30) Foreign Application Priority Data

Oct. 28, 1999 (KR) ..... 99-23406

(51) Int. Cl.[7] ..... B65D 85/00
(52) U.S. Cl. ..... 206/315.9; 206/820
(58) Field of Search ..... 206/315.1, 315.9, 206/538, 539, 820

(56) References Cited

U.S. PATENT DOCUMENTS 3,021,001 A * 2/1962 Donofrio ..... 206/820
3,811,564 A * 5/1974 Braber ..... 206/469
3,921,805 A * 11/1975 Compere ..... 206/532
4,671,406 A * 6/1987 Baer ..... 206/315.9
4,773,557 A * 9/1988 Ohta ..... 220/258.2
4,875,620 A * 10/1989 Lane, Sr. ..... 206/820
5,044,495 A * 9/1991 Wyslotsky ..... 206/315.9
D331,011 * 11/1992 Karita et al. ..... D9/415
5,320,225 A * 6/1994 Kirkpatrick ..... 206/449
D387,664 * 12/1997 Bright et al. ..... D9/414
5,848,690 A * 12/1998 Granger et al. ..... 206/315.9
D403,957 * 1/1999 Bright et al. ..... D9/428
5,873,483 A * 2/1999 Gortz et al. ..... 220/269
5,875,891 A * 3/1999 Snell ..... 206/315.9
6,021,896 A * 2/2000 Marshall ..... 206/315.9
6,054,679 A * 4/2000 Ito et al. ..... 156/273.9
6,155,423 A * 12/2000 Katzner et al. ..... 206/531

* cited by examiner

*Primary Examiner*—Shian Luong
(74) *Attorney, Agent, or Firm*—Schmeiser, Olsen & Watts

(57) ABSTRACT

A case for a golf ball includes a body for accommodating and protecting a single golf ball, the body having an inlet formed at one side thereof so that the golf ball can easily pass. A cover is attached to the inlet of the body forming a seal to prevent the golf ball accommodated in the body from exposure to external air. The cover is separated from the inlet by a force applied over a predetermined degree.

2 Claims, 4 Drawing Sheets

CASE FOR GOLF BALL

BACKGROUND OF THE INVENTION

1. Field of the Invention

The present invention relates to a case for a golf ball, and more particularly, to a case for a golf ball in which a golf ball is separately contained so that the golf ball can be easily carried and kept in an optimal state with no discoloring of nor damage to the golf ball.

2. Description of the Related Art

A typical golf ball has a white surface with dimples formed thereon for the purpose of reducing air resistance. The outer surface of a golf ball is formed of Balata™ or lonomer resins having superior elasticity. If the outer surface of a golf ball is exposed to external air or moisture for a long time, the color of the ball fades away and the elasticity and rotational force thereof are lowered so that some of the original performance is lost.

Also, while a golfer plays a golf game on a large golf course having a drivers environment, since a golf ball may be damaged by hitting against hindrances such as trees or falling into a pond, or may even get lost, the golfer usually carries extra balls, just in case.

A typical golf ball package is a box type golf ball case containing a dozen golf balls in four sleeves, each sleeve containing three golf balls. Thus, when necessary, the golfer takes one or two golf balls out of a sleeve in the golf ball case and keeps them in a pocket while putting the other balls in the golf ball case in a golf bag.

When a golf ball is not lost during play and is kept in use, the balls kept in a pocket or golf bag are placed again in the golf case and kept for a long time. However, once the conventional golf ball case is opened, external air or moisture intrudes into the case to fade the golf ball and lower the elasticity of the ball so that the performance of the ball is lowered for the long run. Also, while carrying the extra balls in the pocket or golf bag, since there is no method to protect the balls, the balls fade even more or are damaged, or the elasticity of the balls is deteriorated.

To solve the above problems, a conventional rectangular golf ball case having a cover and a box having a superior seal feature for keeping about three golf balls has been used. However, when the cover is open, the external air still affects the balls remaining in the case, and a golfer should inconveniently carry about two extra golf balls in a pocket with the golf ball case or in the golf bag.

Thus, once the conventional golf ball case is opened, the discoloring and the lowering of the elasticity of the remaining balls can not be prevented. Also, while a golfer carries the balls, the discoloring and lowering of the elasticity and rotational force cannot be prevented. Furthermore, it is inconvenient to carry the box type golf ball case which is large to protect the golf balls while the golfer carries them.

Also, when a golfer does not play frequently, the open balls are kept while being exposed to the external air for a long time. Furthermore, since it is difficult to discern how long a ball has been exposed, some balls are kept for a long time without being used, which may deteriorate the performance of the balls.

Since 99% or more golf balls are packaged by using cardboard, even if the case is not opened, the performance of balls kept in the case naturally deteriorates. That is, as shown in FIG. 5, for the golf balls packaged in a conventional cardboard golf ball case, regardless of whether the balls are specifically designed for long distance or high spin (distance purpose balls and spin purpose balls), the loss in distance increases according to the passage of time so that, after 18 months have passed, the loss in distance is about 10 to 15 yards.

SUMMARY OF THE INVENTION

To solve the above problems, it is an objective of the present invention to provide a case for a golf ball having a body containing a single golf ball and a cover for completely cutting off external air, which enables a golf ball to be kept from external air and moisture so that a golf ball can be kept for a long time without lowering its performance.

It is another objective of the present invention to provide a case for a golf ball in which bodies are connected and a cutting line is formed between the bodies so that a user can detach as many bodies containing balls as the user wants and carry the balls, and in which since a body is formed of a light material and has a spherical surface and a cover formed of an aluminum thin film so that bodies containing balls can be conveniently carried and kept.

It is yet another objective of the present invention to provide a case for a golf ball for preventing a golf ball from being shaken by external impacts and having protrusions on the inner surface of the body for reducing an area of contact with a golf ball, or a soft bag serving as a buffering and secondary sealing element, so that damage to the golf ball while carrying the ball can be prevented.

The corner portions of each case should be rounded so as not to cut the hand of a user when kept in pocket.

BRIEF DESCRIPTION OF THE DRAWINGS

The above objectives and advantages of the present invention will become more apparent by describing preferred embodiments thereof in detail with reference to the attached drawings in which.

DETAILED DESCRIPTION OF THE INVENTION

Figure 1:
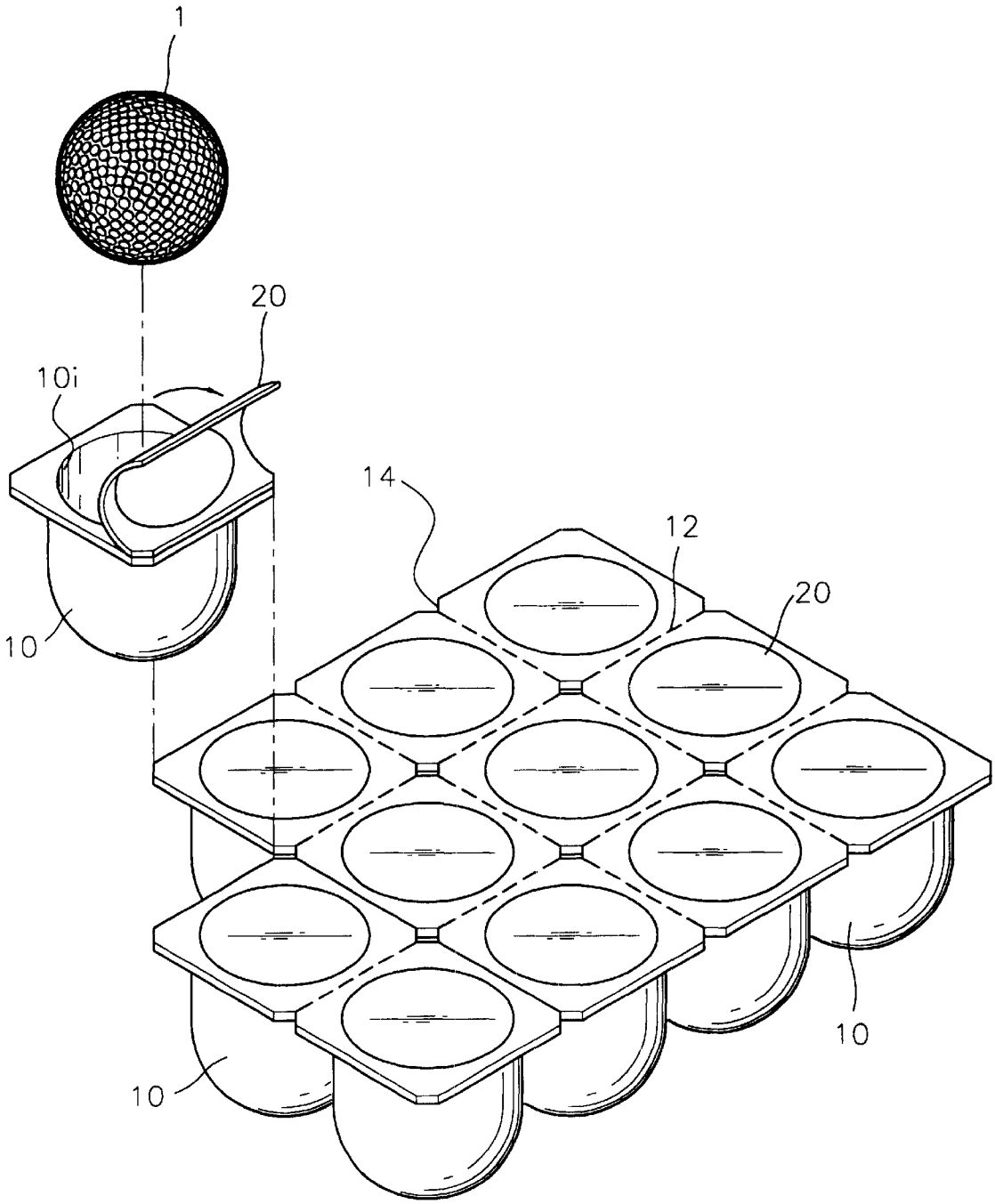
FIG. 1 is a perspective view showing a case for a golf ball according to a preferred embodiment of the present invention.
Figure 2:
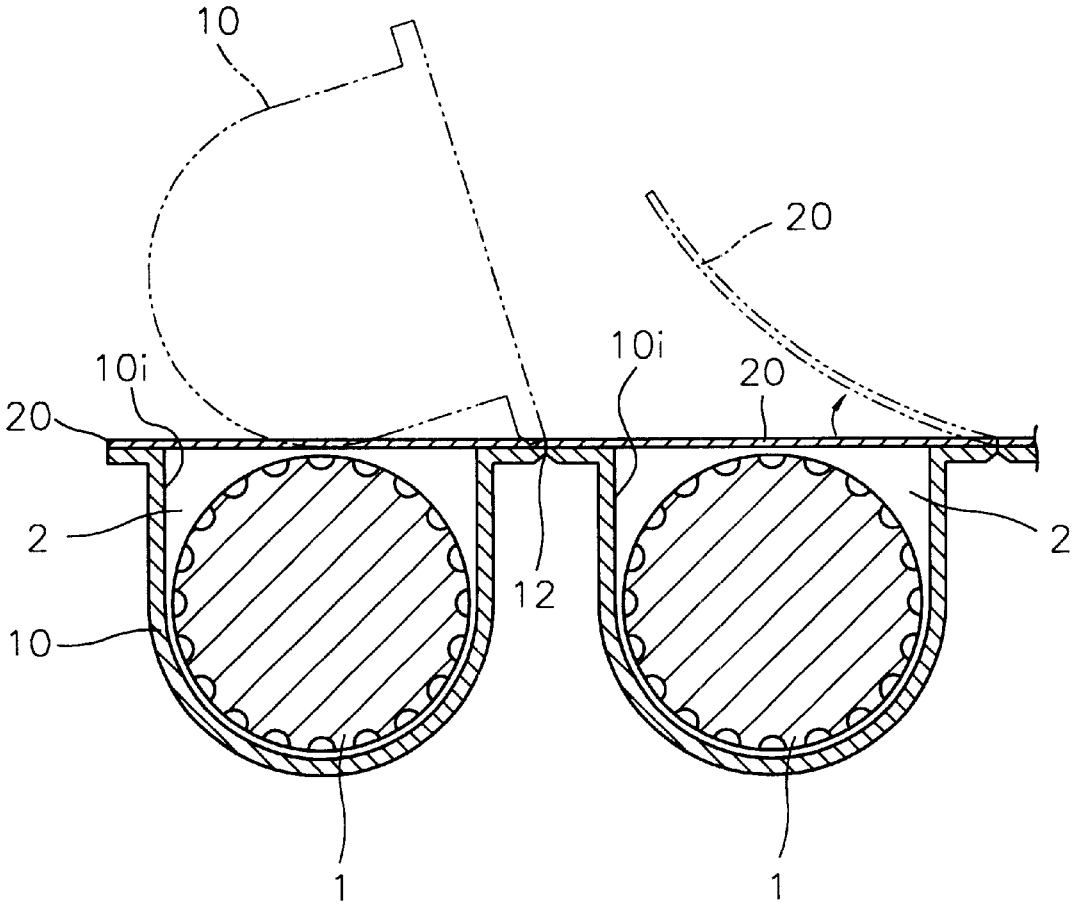
FIG. 2 is a cross-sectional view showing the state in which a golf ball is contained in a body shown in FIG. 1.

Referring to FIGS. 1 and 2, a case for a golf ball according to a preferred embodiment of the present invention, which is a separate package for a single golf ball, includes a body 10 rigid enough to protect a golf ball 1 from expected external impact, and a cover 20 attached to the body 10.

That is, the body 10 has an inlet **10*i* formed at an upper portion of the body 10 through which the golf ball 1 passes. The body 10 has a structure for protecting the golf ball 1 by separately accommodating the golf ball 1**.

Here, the shape of the body 10 may vary and be, for example, rectangular, spherical or cylindrical. It is obvious to modify and change the shape within the scope of the technical concept of the present invention to accommodate a single golf ball.

Here, as one of examples of bodies having various shapes, the body 10 according to a preferred embodiment of the present invention, as shown in FIGS. 1 and 2, has a circular inlet **10*i* having a diameter greater than that of the golf ball 1 formed at the upper portion of the body 10, a spherical surface corresponding to the shape of the golf ball 1 at the lower portion thereof, and the profile thereof is a U shape, and it is formed of rigid synthetic resin, so that it can be conveniently carried and the golf ball 1** can be easily taken out.

Also, the cover 20 of the present invention is attached to the inlet 10*i* of the body 10 to protect the golf ball 1 accommodated in the body 10 from external air, forming a seal. The cover 20 is detachable from the inlet 10*i* by a force over a predetermined degree. Preferably, the cover 20 is fabricated by using a soft aluminum thin film and is attached by an adhesive at the inlet 10*i* of the body 10.

Here, other than the aluminum thin film, the cover 20 can be formed of various materials such as synthetic resin based material, for example, vinyl. Also, it is possible to fabricate the cover 20 to be transparent to check the golf ball 1 on the condition that the golf ball 1 is not discolored due to sun shine or a ultraviolet ray.

Also, by filling the inside of the body 10 which is sealed by the cover 10 with nitrogen gas 2, a raw rubber layer of the golf ball 1 can be prevented from reacting with oxygen. The golf ball can be protected by cutting off external air by various methods such as filling the inside with various fillers other than nitrogen or forming a vacuum state.

Although the case for a golf ball of the present invention may be used as a unit package having the body 10 and the cover 20 containing a single golf ball, a plurality of the unit packages of the golf ball can be preferably connected, considering convenience in fabrication, distribution and sale thereof.

That is, a plurality of the bodies 10 having the same size are connected to one another and the connecting portion is made thin, or a cutting line 12 along which the bodies 10 are detached is made, so that a user can keep a plurality of the golf balls 1 and detach as many of the separately packaged golf balls 1 as the user wants, when necessary.

Here, since the cover 20 is not cut corresponding to the body 10 in advance, but is cut off concurrently when the body 10 is cut, the cover 20 can be printed as a separate size or a size corresponding to 12 golf balls. The technique of making the cutting line 12 is well known so that one skilled in the art can easily modify and change the cutting line 12. Preferably, the cutting line 12 is formed such that the body 10 is detached by bending it in a direction opposing the side where the cutting line is formed.

Thus, a user can detach as many of the bodies 10 as the user wants from a block in which a plurality of the bodies 10 separately packaging the golf balls 1 are connected, so that the user can carry the detached bodies 10 and use the golf balls 1 by detaching the cover 20 whenever the golfer desires. Thus, the user can keep a golf ball in an optimal state since the golf ball 1 accommodated in the body 10 has never been exposed to external air or moisture.

Here, by detaching all bodies 10 along the cutting lines 12, the body 10 can be kept in various places such as a the pocket or a golf bag. The unused golf ball cases can be kept for a long time with no discoloring or damaging of the golf balls, so that a user can use fresh balls whenever the user wants.

In manufacturing the golf ball case according to the present invention, a plurality of bodies 10 are manufactured by a press/injection method using a synthetic resin plate. Then, golf balls are inserted in the respective bodies 10, and the cover 20, such as an aluminum thin film, where an adhesive has already been coated, is attached to the bodies 10. Thus, compared to the conventional box type case, the cost for manufacturing the case for a golf ball according to the present invention may be much lower. Also, since a process of assembling a box (sleeve) in the conventional cardboard package can be omitted, the cost for manpower can also be reduced.

Here, as shown in FIG. 1, a cutting groove 14 is formed on the body 10 for convenience in detaching the body 10. Also, a tab portion is formed at one side of the cover 20 which is previously separated or protrudes so that the cover 20 can be easily detached. Since the technology of the tab portion is well known and commercialized, a detailed description thereof will be omitted.

Also, since the body 10 and the cover 20 are discarded after use, they can be preferably formed of a light synthetic resin based material, and further, the use of a recyclable environment-friendly material is preferable.

Figure 3:
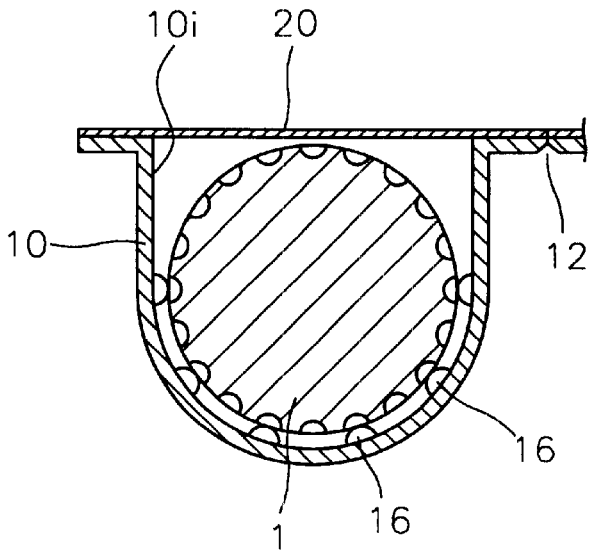
FIG. 3 is a cross-sectional view showing a case for a golf ball according to another preferred embodiment of the present invention.
Figure 4:
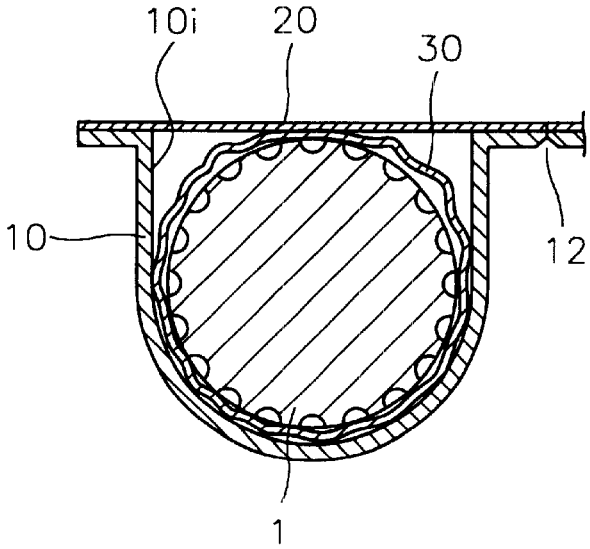
FIG. 4 is a cross-sectional view showing a case for a golf ball according to yet another preferred embodiment of the present invention.

As shown in FIG. 3, in a case for a golf ball according to another preferred is embodiment of the present invention, a plurality of protrusions 16 having a rounded surfaces, or uneven portions can be formed at the inner surface of the body 10 in order to decrease a contact area between the inner surface of the body 10 and the golf ball 1 and improve the rigidity of the body 10. As shown in FIG. 4, in a case for a golf ball according to yet another preferred embodiment of the present invention, the golf ball 16 can be separately packed into a soft bag 30 (cardboard or plastic bag).

Other than the above materials, various fillers, buffering members, or double or triple package members can be used. In this regard, the technology can be modified and changed within the scope of the technical concept of the present invention.

Figure 5:
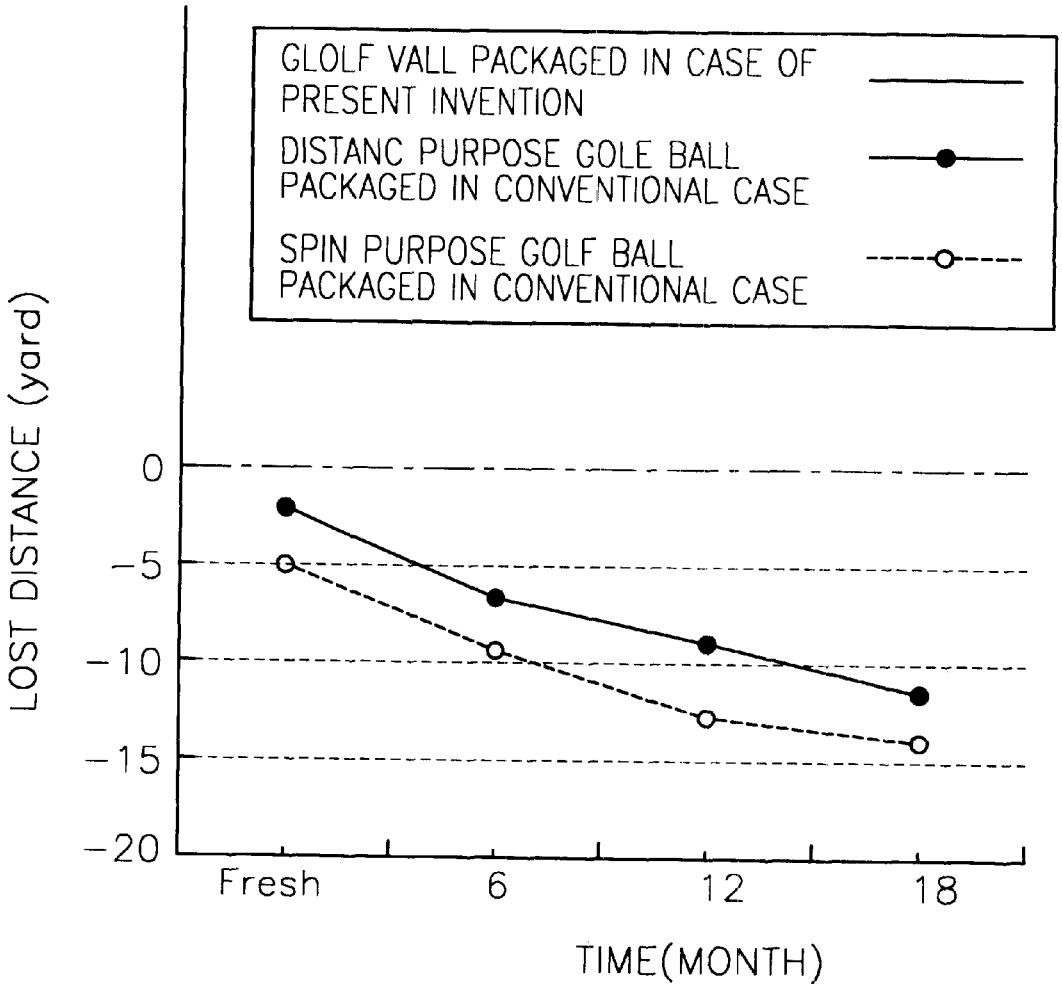
FIG. 5 is a graph showing the loss in distance according to the passage of time for a golf ball packaged in the golf ball case of the present invention and golf balls packaged in conventional golf ball cases.

Therefore, the golf ball 1 contained in the golf ball case according to the present invention in which the golf ball 1 is separately packed forming a complete seal remains fresh. That is, as shown in FIG. 5, no natural loss in distance is found after several years have passed, whereas a loss of distance is usually found in a golf ball kept in the conventional case. For golf balls packaged in the conventional cardboard golf ball case, regardless of distance purpose golf balls and spin purpose golf balls, the loss in distance according to the passage of time increases so that a loss of about 10 to 15 yards occurs after 18 months have passed since the manufacture thereof. However, golf balls packaged in the case according to the present invention can always be used as new balls.

As described above, according to the golf ball case according to the present invention, since golf balls in the optimal state of not being exposed to external air or moisture can be used, the performance of the golf balls is maintained to its greatest extent. Also, since the golf balls can be kept for a long time as they are, it is easy to carry and keep the golf balls. Further, damage to golf balls during carrying and handling the balls can be prevented.

What is claimed is:

1. The case as claimed, wherein the bodies are filled with nitrogen gas, and a plurality of protrusions having spherical surfaces are formed at an inner surface thereof to reduce a contact area between the inner surface of the bodies and each of the golf balls.

2. The case as claimed, wherein each of the plurality of bodies further comprises a soft bag, each of the plurality of bodies containing a golf ball therein.

* * * * *

UNITED STATES PATENT AND TRADEMARK OFFICE

CERTIFICATE OF CORRECTION

PATENT NO. : 6,523,686 B1
DATED : February 25, 2003
INVENTOR(S) : Sung-woo Bae

It is certified that error appears in the above-identified patent and that said Letters Patent is hereby corrected as shown below:

Column 4,
Lines 55-63, delete under "What is claimed is:" and
insert the following instead:

1. A case for a golf ball comprising: a plurality of bodies for accommodating and individually protecting each of a plurality of golf balls, the bodies having an inlet formed at one side thereof so that each of the golf balls can easily pass: and a cover attached to the inlet of the bodies forming a seal to prevent each of the golf balls accommodated in the bodies from exposure to external air, the cover separated from the inlet by a force applied over a predetermined degree, wherein the bodies are filled with nitrogen gas, and a plurality of protrusions having spherical surfaces are formed at an inner surface thereof to reduce a contact area between the inner surface of the bodies and each of the golf balls.

2. A case for a golf ball comprising: a plurality of bodies for accommodating and individually protecting each of a plurality of golf balls, the bodies having an inlet formed at one side thereof so that each of the golf balls can easily pass; and a cover attached to the inlet of the bodies forming a seal to prevent each of the golf balls accommodated in the bodies from exposure to external air, the cover separated from the inlet by a force applied over a predetermined degree, wherein each of the plurality of bodies further comprises a soft bag, each of the plurality of bodies containing a golf ball therein.

Signed and Sealed this

Third Day of June, 2003

JAMES E. ROGAN
*Director of the United States Patent and Trademark Office*